US009476012B2

(12) United States Patent
Schramm et al.

(10) Patent No.: US 9,476,012 B2
(45) Date of Patent: Oct. 25, 2016

(54) ESTERQUAT COMPOSITION HAVING HIGH TRIESTERQUAT CONTENT

(71) Applicant: Colgate-Palmolive Company, New York, NY (US)

(72) Inventors: Charles J. Schramm, Hillsborough, NJ (US); Katie Truong, Piscataway, NJ (US); Karen L. Wisniewski, Bound Brook, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/650,713

(22) PCT Filed: Dec. 11, 2012

(86) PCT No.: PCT/US2012/068967

§ 371 (c)(1),
(2) Date: Jun. 9, 2015

(87) PCT Pub. No.: WO2014/092692

PCT Pub. Date: Jun. 19, 2014

(65) Prior Publication Data

US 2015/0315521 A1 Nov. 5, 2015

(51) Int. Cl.

| | |
|---|---|
| ***C11D 1/62*** | (2006.01) |
| ***C11D 3/30*** | (2006.01) |
| ***C11D 3/37*** | (2006.01) |
| ***C11D 11/00*** | (2006.01) |
| ***C11D 3/00*** | (2006.01) |

(52) U.S. Cl.
CPC . *C11D 3/30* (2013.01); *C11D 1/62* (2013.01); *C11D 3/001* (2013.01); *C11D 3/0015* (2013.01); *C11D 3/3769* (2013.01); *C11D 3/3773* (2013.01); *C11D 11/0082* (2013.01)

(58) Field of Classification Search
CPC ..... C11D 1/46; C11D 1/62; C11D 3/0015
See application file for complete search history.

(56) References Cited

U.S. PATENT DOCUMENTS

| | | | |
|---|---|---|---|
| 3,915,867 | A | 10/1975 | Kang et al. |
| 5,916,863 | A | 6/1999 | Iacobucci et al. |
| 6,004,913 | A | 12/1999 | Iacobucci et al. |
| 6,037,315 | A | 3/2000 | Franklin et al. |
| 6,770,608 | B2 | 8/2004 | Franklin et al. |
| 6,864,223 | B2 | 3/2005 | Smith et al. |
| 6,949,500 | B2 | 9/2005 | Salesses et al. |
| 7,214,718 | B1 | 5/2007 | Ohtawa et al. |
| 7,585,832 | B2 | 9/2009 | Smith et al. |
| 2002/0132749 | A1 | 9/2002 | Smith et al. |
| 2003/0036499 | A1 | 2/2003 | Ohtawa et al. |
| 2004/0116322 | A1 | 6/2004 | Yianakopoulos et al. |
| 2004/0142840 | A1 | 7/2004 | de Buzzaccarini et al. |
| 2004/0229769 | A1 | 11/2004 | Smith et al. |
| 2005/0009728 | A1 | 1/2005 | Smith et al. |
| 2007/0032399 | A1 | 2/2007 | Smith et al. |
| 2010/0197560 | A1 | 8/2010 | Nepras et al. |

FOREIGN PATENT DOCUMENTS

| | | |
|---|---|---|
| EP | 1354869 | 7/2004 |
| EP | 0707059 | 9/2004 |
| WO | WO 93/23510 | 11/1993 |
| WO | WO 00/06678 | 2/2000 |
| WO | WO 01/32813 | 5/2001 |
| WO | WO 2007/090567 | 8/2007 |
| WO | WO 2007/092020 | 8/2007 |
| WO | WO 2008/005693 | 1/2008 |

OTHER PUBLICATIONS

International Search Report and Written Opinion in International Application No. PCT/US2012/068967, mailed Sep. 18, 2013.
Written Opinion in International Application No. PCT/US2012/068967, mailed Nov. 19, 2014.
Wilkes et al., 1996, "Characterization of quaternized triethanol amine esters (esterquats) by HPLC, HRCGC AND NMR," 4th World Surfactants Congress, Barcelone, 3-7 VI, p. 382.

*Primary Examiner* — John Hardee

(57) ABSTRACT

A composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a water swellable cationic polymer. The water swellable cationic polymer aids in dispersion and/or in deposition of the triesterquat. Also, a method of producing such a composition and a method of softening a fabric, and increasing fragrance delivery, comprising treating the fabric with the composition.

29 Claims, No Drawings

ESTERQUAT COMPOSITION HAVING HIGH TRIESTERQUAT CONTENT

BACKGROUND OF THE INVENTION

Esterquat, a quaternary ammonium compound, is known for use as a fabric softening molecule. It is typically formed when the reaction product of long chain (C12-C22 or C16-C18) fatty acids and a tertiary amine is esterified in the presence of an acid catalyst and subsequently quaternized to obtain quaternary ammonium salts. The final product is a mixture of mono-, di- and triester components.

Quaternary ammonium compounds exhibiting particularly good fabric softening performance and stability profiles are obtained from reaction of C12-C22 fatty acids or the hydrogenation products, usually containing some degree of unsaturation, having an iodine value range of 20-90.

Triethanol amine (TEA) tallow fatty acid esterquats have been one mainstay for fabric conditioners since the late 1990's. The triesterquat component of triethanol amine (TEA) esterquat has been generally held to have poor softening and fragrance delivery performance. The prior art has generally focused on efforts to enhance the diesterquat component which was claimed to maximize softening efficacy.

The costs of raw materials required for production of triethanol amine based esterquats such as fatty acids and dimethyl sulfate are increasing significantly in line with oil price increases. TEA esterquats are composed of mono-, di-, and tri-esterquats with residual mono-, di-, and tri-ester amines. This complicated chemistry results in emulsions that contain several types of emulsion structures, some of which do not effectively contribute to softening performance upon dilution in water during the rinse cycle of a fabric washing process because of their high solubility in water. This becomes particularly noticeable in fabric softening compositions in which the initial product active levels are reduced, resulting in less structure in the initial product emulsion.

Another difficulty of this esterquat system is that the complicated chemistry also makes it hard for a formulator to adjust or add other ingredients to the formulation: each emulsion structure reacts in its own way to the formula change and makes it very difficult for the formulator to balance all the different changes.

There is therefore a need in the art for an esterquat composition, in particular for use as a fabric softening composition, which can have at least one of lower cost, a less complex formulation and/or manufacturing process, equivalent or higher softening and/or fragrance delivery performance, and consistent and predictable properties and performance as compared to known esterquat compositions.

There is, in particular, a need in the art for an esterquat composition for use in a fabric conditioner which can have a lower cost but at least a substantially equivalent softening and fragrance delivery performance as compared to known esterquat compositions for fabric conditioners.

BRIEF SUMMARY OF THE INVENTION

The present invention accordingly provides a composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a water swellable cationic polymer.

In certain embodiments, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (ii). These polymers are described in U.S. Pat. No. 6,864,223.

The amount of triesterquat is at least 90 wt % of the esterquat, optionally at least 94 wt % of the esterquat, further optionally at least 99 wt % of the esterquat.

Optionally, from 0 wt % to up to 5 wt %, typically from 0 wt % to up to 1 wt %, of the esterquat is comprised of monoesterquat.

Optionally, the alkanol amine comprises triethanol amine.

Optionally, the fatty acids are those in tallow. However, in any of the embodiments of the invention the fatty acid may comprise any fatty acid having from 12 to 22 carbon atoms, typically from 16 to 18 carbon atoms.

Optionally, the tallow fatty acid has a degree of saturation, based on the total weight of fatty acids, of from 40 to 90%. Optionally, the tallow fatty acid has an iodine value of from 10 to 70.

Optionally, the cationic linear copolymer (i) is derived from the polymerization of a salt of methacrylic acid and acrylamide.

Optionally, in the polymerization of the cationic linear copolymer (i) the salt comprises a quaternary ammonium salt of an acrylate or methacrylate, further optionally a quaternary ammonium salt of dimethyl aminoethyl methacrylate.

Optionally, the cationic linear copolymer (i) has a molecular weight of from about 2 million to about 3 million.

Optionally, the cationic cross-linked polymer (ii) is derived from the polymerization using 75 to 200 ppm of the cross-linking agent, further optionally 80 to 150 ppm of the cross-linking agent.

Optionally, the cationic cross-linked polymer (ii) is derived from the polymerization of a salt of methacrylic acid and acrylamide.

Optionally, in the polymerization of the cationic cross-linked polymer (ii) the salt comprises a quaternary ammonium salt of an acrylate or methacrylate, further optionally a quaternary ammonium salt of dimethyl aminoethyl methacrylate.

Optionally, in the polymerization of the cationic cross-linked polymer (ii), the polymer prior to cross-linking has a molecular weight of from about 2 million to about 3 million.

Optionally, in the polymerization of the cationic cross-linked polymer (ii), the cross-linker comprises methylene bis acrylamide.

Optionally, the composition comprises from 1.5 to 5 wt % triesterquat, further optionally from 2 to 3.5 wt % triesterquat, still further optionally about 3 wt % triesterquat, based on the weight of the composition.

Optionally, the composition comprises from 0.0.05 to 0.5 wt % of the water swellable cationic polymer, further optionally from 0.1 to 0.5 wt % of the water swellable cationic polymer, still further optionally 0.15 to 0.25 wt % or about 0.2 wt % of the water swellable cationic polymer, based on the weight of the composition.

Optionally, the weight ratio of triesterquat to the water swellable cationic polymer is from 25:1 to 5:1, further optionally from 20:1 to 10:1, still further optionally from 17.5:1 to 12.5:1, yet further optionally about 15:1.

The composition may optionally further comprise a fragrance, and further optionally the fragrance is present in an amount of from 0.25 to 1 wt % fragrance, still further optionally from 0.4 to 0.5 wt % fragrance, based on the weight of the composition.

Optionally, the composition may further comprise a silicone dispersion for encapsulating the fragrance. Further optionally, the silicone is present in an amount of from 0.1 to 0.5 wt %, based on the weight of the composition. Optionally, the fragrance and silicone are present in weight ratio of from 5:1 to 1:1.

The composition may optionally further comprise a solvent, and typically the solvent comprises water.

Optionally, the triesterquat is dispersed as an emulsion in the solvent, and the emulsion comprises particles including a mixture of the triesterquat and the water swellable cationic polymer. Optionally, the particles have an average particle size of from 10 to 40 microns, further optionally from 10 to 20 or 12 to 18 microns.

Optionally, the composition is a fabric softener composition.

The present invention also provides a method of producing a composition according to the invention, the method comprising the steps of:

a) providing, as the solvent, water at a temperature of from 30 to 60° C.;
b) dispersing the water swellable cationic polymer into the water and mixing to form an aqueous dispersion;
c) adding the triesterquat to the aqueous dispersion; and
d) mixing the resultant mixture to produce the composition in which the triesterquat is dispersed as an aqueous emulsion, and the aqueous emulsion comprises particles including a mixture of the triesterquat and the water swellable cationic polymer.

Optionally, in step a) the water is at a temperature of from 50 to 60° C.

Optionally, in step d) the mixing is carried out so that the particles have an average particle size of from 10 to 40 microns, further optionally from 10 to 20 microns or 12 to 18 microns.

Optionally, in step d) the mixing is carried out for a period of from 1 to 4 minutes using a shearing mixer to form the emulsion.

Optionally, in step c) the esterquat is dispersed into the water in the form of a molten liquid. Optionally, the molten liquid includes fragrance.

Optionally, the method is for producing a fabric softener composition.

The present invention also provides a method of softening a fabric comprising treating the fabric with a composition of the invention or produced by a method of the invention.

Optionally, the composition further comprises a fragrance and the method provides fragrance delivery onto the fabric.

The present invention also provides the use of a composition of the invention or produced by a method of the invention as a fabric softener.

The present invention is at least partly predicated on the finding by the present inventors that a water swellable cationic polymer, such as the cationic linear copolymer (i) identified above and/or the cationic cross-linked polymer (ii) identified above, when used alone or as a mixture, can act as an effective polymeric dispersion/deposition aid for triesterquat to provide a stable dispersion of the triesterquat in a solvent, particularly water, which is effective in softening performance and fragrance delivery.

In particular, the inventors found that a low cost TEA esterquat could be provided by a triesterquat which exhibited a less complicated chemical composition than known mixtures of mono-, di- and tri-esterquats. A preferred composition includes at least 90 wt % triester in the esterquat, and may include as little as less than 1% of the highly soluble monoesterquat.

This reduced monoesterquat composition significantly reduces the potential loss of effective softening actives during the fabric rinse process. Although some inherent dispersibility is maintained by the triesterquat component, so that when only the triesterquat is added to water a triesterquat dispersion is able to form, the resulting emulsion exhibits limited stability and softening effectiveness, and so is not technically and commercially acceptable. However, by combining the triesterquat with the polymeric dispersion/deposition aid in accordance with the preferred embodiments of the invention, the stability and performance of the triesterquat can be significantly enhanced, to provide a technically and commercially acceptable esterquat composition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

AI refers to the active weight of the combined amounts for monoesterquat, diesterquat, and triesterquat.

Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally.

The present invention accordingly provides a composition comprising (a) an esterquat that is a quaternized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a water swellable cationic polymer.

The water swellable cationic polymer aids in dispersing the triesterquat in an aqueous composition and/or aids in depositing the triesterquat onto fabric. Triesterquat has been minimized in compositions because it is not very dispersible in an aqueous compositions.

In certain embodiments, the water swellable cationic polymer has a charge density of 4 to 5 meq/g. In other embodiments, the charge density is 4 to 4.5, 4 to less than 4.5, about 4.5, 4.5 to 5, or greater than 4.5 to 5 meq/g.

In one embodiment, the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylamide, said copolymer having a molecular weight of from about 10,000 to about 30 million; and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (ii).

In general, esterquats are represented by the following structure:

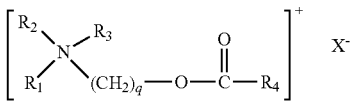

wherein $R_4$ represents an aliphatic hydrocarbon group having from 8 to 22 carbon atoms, $R_2$ and $R_3$ represent $(CH_2)_s$—$R_5$ where $R_5$ represents an alkoxy carbonyl group containing from 8 to 22 carbon atoms, benzyl, phenyl, (C1-C4)-alkyl substituted phenyl, OH or H; $R_1$ represents $(CH_2)_t$ $R_6$ where $R_6$ represents benzyl, phenyl, (C1-C4)-alkyl substituted phenyl, OH or H; q, s, and t, each independently, represent an integer from 1 to 3; and $X^{31}$ is a softener compatible anion.

The esterquat is typically produced by reacting fatty acid methyl ester with alkanol amine followed by quaternization with dimethyl sulfate (further details on this preparation method are disclosed in U.S. Pat. No. 3,915,867). In certain embodiments, the alkanol amine comprises triethanol amine. The fatty acids can be any fatty acid that is used for manufacturing esterquats for fabric softening. In any of the embodiments of the invention the fatty acid may comprises any fatty acid having from 12 to 22 carbon atoms, typically from 16 to 18 carbon atoms. Examples of fatty acids include, but are not limited to, the fatty acids contained in coconut oil, palm oil, tallow, rape oil, fish oil, or chemically synthesized fatty acids. In certain embodiments, the fatty acids are those contained in tallow.

In accordance with the invention, the reaction is carried out so as to have a high amount of triesterquat, and low amounts of monoesterquat and diesterquat.

In some embodiments, from 0 wt % to up to 5 wt %, typically from 0 wt % to up to 1 wt %, of the esterquat is comprised of monoesterquat. The amount of triesterquat is at least 90 wt % of the esterquat, optionally at least 95 wt % of the esterquat, further optionally at least 99 wt % of the esterquat.

The selection of a particular molar ratio between the fatty acid methyl ester with alkanol amine controls the amount of each of monoesterquat, diesterquat, and triesterquat in the composition. By selecting a ratio of about 2.5:1 to 3:1 fatty acid methyl ester to alkanol amine, the triesterquat can be maximized while decreasing or minimizing the monoesterquat.

The percentages, by weight, of mono, di, and tri esterquats, as described above are determined by the quantitative analytical method described in the publication "Characterisation of quaternized triethanol amine esters (esterquats) by HPLC, HRCGC and NMR" A. J. Wilkes, C. Jacobs, G. Walraven and J. M. Talbot—Colgate Palmolive R&D Inc.—$4^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the amount of esterquat in the composition is up to 35% by weight, optionally up to 10%, up to 9%, up to 8%, up to 7%, up to 6%, or up to 5% by weight. In certain embodiments, the amount is 0.01 to 35%, 1 to 10%, 1 to 8%, 1 to 5%, 1.5 to 5%, or 2 to 3.5% by weight, preferably 1.5 to 5% or 2 to 3.5% by weight.

In certain embodiments, the fatty acids may be saturated or partly unsaturated. Typically the fatty acids, such as the tallow fatty acids, have a degree of saturation, based on the total weight of fatty acids, of from 0 to 80%. Optionally, the tallow fatty acid has an iodine value of from 20 to 70.

Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard: soft tallow as the source of the fatty acids.

By hard, it is meant that the fatty acids from the tallow are close to full hydrogenation. In certain embodiments, a fully hydrogenated fatty acid has an iodine value of 10 or less. By soft, it is meant that the fatty acids from the tallow are only partially hydrogenated. In certain embodiments, a partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard tallow fatty acids and soft tallow fatty acids cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

At higher AI levels, larger amounts of saturated fatty acids deliver more noticeable results than lower AI levels because the absolute amount of saturated fatty acid is greater, which provides a noticeable difference. While there is still a difference in result at lower AI, the result is less noticeable.

In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

While the esterquat can be provided in solid form, it is usually present in a solvent in liquid form. In certain embodiments, the solvent comprises water.

Triesterquat is not highly soluble in water. The water swellable cationic polymer is provided to increase the dispersibility of the triesterquat in the water so that the esterquat forms particles of an aqueous emulsion which has stability prior to use and can be delivered to fabric during use to effect fabric softening.

In embodiments the cationic surface charge of the emulsion particle, provided by the water swellable cationic polymer (i) and/or (ii), assures that the emulsion particle may exhibit effective fabric deposition during the rinse process.

The water swellable cationic polymers (i) and (ii) employed in the preferred embodiments have good solubility in water and good biodegradability.

In certain embodiments, the water swellable cationic linear copolymer (i) is derived from the polymerization of a salt of methacrylic acid and acrylamide. In certain embodiments, in the polymerization of the cationic linear copolymer (i) the salt comprises a quaternary ammonium salt of an acrylate or methacrylate, typically a quaternary ammonium salt of dimethyl aminoethyl methacrylate. In certain embodiments, the cationic linear copolymer (i) has a molecular weight of from about 2 million to about 3 million.

In certain embodiments, the water swellable cationic cross-linked polymer (ii) is derived from the polymerization using 75 to 200 ppm of the cross-linking agent, further optionally 80 to 150 ppm of the cross-linking agent. In certain embodiments, the cationic cross-linked polymer (ii) is derived from the polymerization of a salt of methacrylic acid and acrylamide. In certain embodiments, in the polymerization of the cationic cross-linked polymer (ii) the salt comprises a quaternary ammonium salt of an acrylate or methacrylate, typically a quaternary ammonium salt of dimethyl aminoethyl methacrylate. In certain embodiments, in the polymerization of the cationic cross-linked polymer (ii), the polymer prior to cross-linking has a molecular weight of from about 2 million to about 3 million. In certain embodiments, in the polymerization of the cationic cross-linked polymer (ii), the cross-linker comprises methylene bis acrylamide.

In certain embodiments, the composition comprises from 0.05 to 0.5 wt % of the water swellable cationic polymer, for example from 0.1 to 0.5 wt % of the water swellable cationic polymer, typically 0.15 to 0.25 wt % or about 0.2 wt % of the water swellable cationic polymer, based on the weight of the composition.

In certain embodiments, the weight ratio of triesterquat to the water swellable cationic polymer is from 25:1 to 5:1, for example from 20:1 to 10:1, typically from 17.5:1 to 12.5:1, further typically about 15:1.

The composition can be provided as a fragrance free composition, or it can contain a fragrance. The fragrance can be free or encapsulated. The amount of fragrance can be any desired amount depending on the preference of the user. In certain embodiments, the composition comprises from 0.25 to 1 wt % total fragrance, typically from 0.4 to 0.5 wt % fragrance, based on the weight of the composition.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

In some embodiments, the composition may further comprise a silicone dispersion for encapsulating the fragrance. In some embodiments, the silicone is present in an amount of from 0.1 to 0.5 wt %, based on the weight of the composition. In some embodiments, the fragrance and silicone are present in weight ratio of from 5:1 to 1:1.

Typically, as discussed above, the composition further comprises a solvent, typically water. In certain embodiments, the triesterquat is dispersed as an emulsion in the solvent, and the emulsion comprises particles including a mixture of the triesterquat and the water swellable cationic polymer.

Further optionally, the particles have an average particle size of from 10 to 40 microns, typically from 10 to 20 or 12 to 18 microns.

In some embodiments the composition is a fabric softener composition.

The fabric conditioners may additionally contain a thickener.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis(methylenephosphonic acid); 1-hydroxyethane 1,1-diphosphonic acid (HEDP); and aminotri(methylenephosphonic acid). In certain embodiments, the composition can include amino tri methylene phosphonic acid, which is available as Dequest™ 2000 from Monsanto.

In certain embodiments, the composition can include a C13-C15 Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

The composition can be used to soften fabrics by treating the fabric with the composition. This can be done during the rinse cycle of a wash using a liquid fabric softener.

The present invention also provides a method of producing a composition according to the invention, the method comprising the steps of:

a) providing, as the solvent, water at a temperature of from 30 to 60° C.;
b) dispersing the water swellable cationic polymer into the water and mixing to form an aqueous dispersion;
c) adding the triesterquat to the aqueous dispersion; and
d) mixing the resultant mixture to produce the composition in which the triesterquat is dispersed as an aqueous emulsion, and the aqueous emulsion comprises particles including a mixture of the triesterquat and the water swellable cationic polymer.

In certain embodiments, in step a) the water is at a temperature of from 50 to 60° C.

In certain embodiments, in step d) the mixing is carried out so that the particles have an average particle size of from 10 to 40 microns, further optionally from 10 to microns or 12 to 18 microns.

In certain embodiments, in step d) the mixing is carried out for a period of from 1 to 4 minutes using a shearing mixer to form the emulsion.

In certain embodiments, in step c) the esterquat is dispersed into the water in the form of a molten liquid. In certain embodiments, the molten liquid includes fragrance.

In certain embodiments, the method is for producing a fabric softener composition.

The present invention also provides a method of softening a fabric comprising treating the fabric with a composition of the invention or produced by a method of the invention.

In certain embodiments, the composition further comprises a fragrance and the method provides fragrance delivery onto the fabric.

The present invention also provides the use of a composition of the invention or produced by a method of the invention as a fabric softener.

The composition can contain any material that can be added to fabric softeners. Examples of materials include, but are not limited to, surfactants, thickening polymers, colorants, clays, buffers, silicones, fatty alcohols, and fatty esters.

SPECIFIC EMBODIMENTS OF THE INVENTION

The invention is further described in the following examples. The examples are merely illustrative and do not in any way limit the scope of the invention as described and claimed.

Example 1

In Example 1 fabric conditioner compositions based on triethanol amine tallow fatty acid triesterquat were prepared.

In Example 1, deionized water was provided at a temperature of 55° C. A linear cationic polymer having formula (i) as described above was provided in the form of a commercially available FS100-type polymer from SNF. A buffer in the form of lactic acid was provided. A chelating compound having the formula aminotri(methylenephosphonic acid) in the form of a commercially available chelating compound known under the trade name Dequest 2000 from Monsanto was also provided. The water swellable cationic polymer (0.2 wt %), buffer (0.071 wt %), and chelating compound (0.1 wt %) were added to the water (94.29 wt %), all percentages being with respect to the final composition, and mixed under high shear for 2 minutes.

Then molten liquid esterquat, comprising at least 90 wt % triesterquat and less than 1 wt % monoesterquat, admixed with fragrance, was added to the mixing aqueous solution. Such an esterquat having high triesterquat content is available in commerce from Kao Corporation. The triesterquat was added in an amount so as to comprise 5.0 wt % of the final composition. The fragrance was added in an amount so as to comprise 0.5 wt % of the final composition. The resultant mixture was mixed using the high shear mixer for a further period of 4 minutes.

A stable aqueous emulsion is formed of particles of a mixture of the triesterquat and the water swellable cationic polymer.

Example 2

In Example 2, the method of Example 1 was repeated for a number of compositions in which only the amount of the water swellable cationic polymer was modified as compared to Example 1.

The particle size of the esterquat and cationic polymer mixture for different concentrations of the water swellable cationic polymer, ranging from 0.05 to 0.4 wt % was measured and the results are shown in the table below. All particle size measurements were carried out using a Malvern 2000 Mastersizer. The volume average particle size is reported. See Table 1 below.

TABLE 1

| Wt. % Linear Cationic Polymer (FS-100 type) | Particle Size (microns) |
|---|---|
| 0.05 | 32 |
| 0.08 | 31 |
| 0.1 | 22.5 |
| 0.15 | 16.2 |
| 0.15 | 35.3 |
| 0.18 | 23.7 |
| 0.18 | 18.8 |
| 0.2 | 14.2 |
| 0.2 | 15.6 |
| 0.3 | 14.9 |
| 0.4 | 12.1 |

The table above shows that for a triesterquat concentration of 5 wt % the particle size becomes relatively constant when the water swellable cationic polymer has a concentration of at least about 0.2 wt %, and within the range of from 10 to 20 microns, typically from 12 to 18 microns.

Examples 3 To 6 and Comparative Example 1

In Examples 3 to 6, the method of Example 1 was repeated for a number of compositions in which again only the amount of the water swellable cationic polymer was modified as compared to Example 1.

In Examples 3 to 6 the compositions had, respectively, 0.2, 0.15, 0.1 and 0.05 wt % of the same cationic polymer. In each Example there was, as for Example 1, 5 wt % of the same triesterquat.

Comparative Example 1 employed a current commercially available TEA esterquat composition comprising a mono-, di- and triesterquat mixture, which was used as a control composition. The composition employed 5 wt % of the TEA esterquat composition The composition of each of Examples 3 to 6 and Comparative Example 1 were tested to determine the ability of the compositions to deliver fragrance onto fabric on day one and to soften the fabric. These results are also shown in Table 1. The performance of the formulations was tested according to the following protocol:

Protocol

Full Load Wash in standard US type washer

Each experiment used 79 grams product added to the rinse after a wash cycle with 90 grams of an anionic surfactant based detergent. The fabric load consisted of 12 terry hand towels (approximately 1.4 Kg) and a mixed clothing load (approximately 1.6 Kg). There was a 15 minute wash cycle and a 4 minute rinse cycle. All terry towels were line dried. A subset of the towels were cut into smaller pieces and evaluated by a sensory panel for their fragrance intensity on a scale from 1 to 10. Whole towels were folded and evaluated by a sensory panel for their softness intensity on a scale from 1 to 10. Positive (a current commercial fabric softener product) and negative (no softener in rinse) controls were used in the screening tests. Each experiment consisted of the positive and negative controls and 4 experimental products.

Table 2 shows that the water swellable cationic polymer can solubilize high triester containing compositions to make an effective fabric conditioner.

TABLE 2

| | Softener Composition AI | Average Particle Size (μm) | Fragrance | Softness |
|---|---|---|---|---|
| Example 3 | 5 wt % triesterquat/ 0.2 wt % FS-100 type linear cationic polymer | 20 | 5.05 | 7.5 |
| Example 4 | 5 wt % triesterquat/ 0.15 wt % FS-100 type linear cationic polymer | 20 | 4.0 | 4.0 |
| Example 5 | 5 wt % triesterquat/ 0.1 wt % FS-100 type linear cationic polymer | 25 | 3.8 | 4.9 |
| Example 6 | 5 wt % triesterquat/ 0.05 wt % FS-100 type linear cationic polymer | 35 | 3.85 | 5.0 |
| Comparative Example 1 | 5 wt % TEA esterquat control | 20 | 4.95 | 7.5 |

Comparative Examples

Example 1 is repeated with non-water swellable cationic polymers at 0.3 weight % by weight of the composition. The polymers investigated are Polyquaternium-7, Armosoft PQ polyether polyquaternium ammonium chloride, and Alcoclear CCPII 2-propenoic acid, 2-methyl-, 2-(dimethylamino) ethyl ester, homopolymer, acetate. Compositions prepared with Polyquaternium-7 and the Armosoft PQ separated immediately. A composition with Alcoclear CCPII separated overnight. The non-water swellable cationic polymers were not able to form a stable emulsion.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

We claim:

1. A composition comprising (a) an esterquat that is a quatemized reaction product of an alkanol amine and a fatty acid, wherein from at least 90 wt % to up to 100 wt % of the esterquat is comprised of triesterquat and from 0 wt % to up to 10 wt % of the esterquat is comprised of at least one of monoesterquat and diesterquat, and (b) a water swellable cationic polymer.

2. The composition of claim 1, wherein from 0 wt % to up to 5 wt % of the esterquat is comprised of monoesterquat.

3. The composition of claim 1, wherein the alkanol amine comprises triethanol amine.

4. The composition of claim 1, wherein the fatty acid comprises fatty acids from tallow.

5. The composition of claim 4, wherein the tallow fatty acid has a degree of saturation, based on the total weight of fatty acids, of from 0 to 80%.

6. The composition of claim 4, wherein the tallow fatty acid has an iodine value of from 20 to 70.

7. The composition of claim 1, wherein the esterquat is present in an amount of 0.01 to 35% by weight of the composition.

8. The composition of claim 1, wherein the water swellable cationic polymer has a charge density of 4 to 5 meq/g.

9. The composition of claim 1, wherein the water swellable cationic polymer is at least one of (i) a cationic linear copolymer that is derived from the polymerization of acrylic acid and/or methacrylic acid, or a salt of acrylic acid and/or methacrylic acid, and acrylamide or methacrylic, said copolymer having a molecular weight of from about 10,000 to about 30 million: and (ii) a cationic cross-linked polymer that is derived from the polymerization of from 5 to 100 mole percent of cationic vinyl addition monomer, from 0 to 95 mole percent of acrylamide, and from 70 ppm to 300 ppm of a difunctional vinyl addition monomer cross linking agent; or a mixture of polymers (i) and (ii).

10. The composition of claim 9, wherein the cationic linear copolymer (i) is derived from the polymerization of a salt of methacrylic acid and acrylamide.

11. The composition of claim 9, wherein in the polymerization of the cationic linear copolymer (i) the salt comprises a quaternary ammonium salt of an acrylate or methacrylate, optionally the salt comprises a quaternary ammonium salt of dimethyl arninoethyl rnethacrylate.

12. The composition of claim 9, wherein the cationic linear copolymer (i) has a molecular weight of from about 2 million to about 3 million.

13. The composition of claim 9, wherein the cationic cross-linked polymer (ii) is derived from the polymerization using 75 to 200 ppm of the cross-linking agent.

14. The composition of claim 9, wherein the cationic cross-linked polymer (ii) is derived from the polymerization of a salt of methacrylic acid and acrylamide.

15. The composition of claim 14, wherein in the polymerization of the cationic cross-linked polymer (ii) the salt comprises a quaternary ammonium salt of an acrylate or methacrylate.

16. The composition of claim 9, wherein in the polymerization of the cationic cross-linked polymer (ii), the polymer prior to cross-linking has a molecular weight of from about 2 million to about 3 million.

17. The composition of claim 9, wherein in the polymerization of the cationic cross-linked polymer (ii), the cross-linker comprises methylene bis acrylamide.

18. The composition of claim 1, wherein the composition comprises from 0.05 to 0.5 wt % of the water swellable cationic polymer, and from 1.5 to 5 wt % of the esterquat based on the weight of the composition.

19. The composition of a claim 1, wherein from 0 wt % to up to 1 wt % of the esterquat is comprised of monoesterquat and wherein a weight ratio of triesterquat to the water swellable cationic polymer is from 25:1 to 5:1.

20. The composition of claim 1, further comprising a solvent, optionally the solvent is water.

21. The composition of claim 20, wherein the triesterquat is dispersed as an emulsion in the solvent, and the emulsion comprises particles including a mixture of the triesterquat and the water swellable cationic polymer.

22. The composition of claim 21, wherein the particles have an average particle size of from 10 to 40 microns.

23. The composition of any preceding claim 1, which is a fabric softener composition.

24. A method of producing a composition according to claim 1, the method comprising the steps of:

a) providing water at a temperature of from 30 to 60° C.;

b) dispersing the water swellable cationic polymer into the water and mixing to form an aqueous dispersion;

c) adding the triesterquat to the aqueous dispersion; and d) mixing the resultant mixture to produce the composition in which the triesterquat is dispersed as an aqueous emulsion, and the aqueous emulsion comprises particles comprising a mixture of the triesterquat and the water swellable cationic polymer.

25. The method of claim 24, wherein in step a) the water is at a temperature of from 50 to 60° C.

26. The method of claim 24, wherein in step d) the mixing is carried out so that the particles have an average particle size of from 10 to 40 microns.

27. The method of claim 24, wherein in step d) the mixing is carried out for a period of from 1 to 4 minutes using a shearing mixer to form the emulsion.

28. The method of claim 24, wherein in step c) the esterquat is dispersed into the water in the form of a molten liquid.

29. The method of claim 28, wherein the molten liquid includes fragrance.

* * * * *